US007918772B2

(12) United States Patent
Towley, III et al.

(10) Patent No.: US 7,918,772 B2
(45) Date of Patent: Apr. 5, 2011

(54) SELECTORIZED DUMBBELL HAVING A SELECTOR COMPRISING A PIN HAVING FORK-SHAPED CONNECTING PRONG(S)

(75) Inventors: Carl K. Towley, III, Alexandria, MN (US); Gregory S. Olson, Owatonna, MN (US)

(73) Assignee: PowerBlock Holdings, Inc., Owatonna, MN (US)

( * ) Notice: Subject to any disclaimer, the term of this patent is extended or adjusted under 35 U.S.C. 154(b) by 0 days.

(21) Appl. No.: 12/819,186

(22) Filed: Jun. 19, 2010

(65) Prior Publication Data

US 2010/0261587 A1 Oct. 14, 2010

Related U.S. Application Data

(60) Division of application No. 11/888,270, filed on Jul. 31, 2007, now Pat. No. 7,775,947, which is a continuation-in-part of application No. 11/498,314, filed on Aug. 2, 2006, now Pat. No. 7,771,330.

(51) Int. Cl.
*A63B 21/072* (2006.01)
*A63B 21/075* (2006.01)

(52) U.S. Cl. ..... 482/107; 482/108; 482/106

(58) Field of Classification Search ..... 482/106–108, 482/92–94, 97–98, 104, 908, 910
See application file for complete search history.

(56) References Cited

U.S. PATENT DOCUMENTS

| | | | | |
|---|---|---|---|---|
| 1,113,791 | A * | 10/1914 | Latella | 482/50 |
| 1,917,566 | A * | 7/1933 | Wood | 482/108 |
| 1,991,520 | A * | 2/1935 | Postl | 482/108 |
| 3,463,486 | A * | 8/1969 | Forrest, Jr. | 482/106 |
| 3,815,903 | A * | 6/1974 | Blomqvist | 482/103 |
| 4,076,236 | A * | 2/1978 | Ionel | 482/108 |
| 4,529,198 | A | 7/1985 | Hettick, Jr. | |
| 4,659,079 | A * | 4/1987 | Blanchard | 473/60 |
| 4,690,399 | A * | 9/1987 | Hayashi | 482/108 |
| 4,743,017 | A * | 5/1988 | Jaeger | 482/108 |
| 4,799,673 | A * | 1/1989 | Selle | 482/104 |
| 4,911,433 | A * | 3/1990 | Walker et al. | 482/105 |
| 4,974,837 | A * | 12/1990 | Someya et al. | 482/98 |
| 5,029,849 | A * | 7/1991 | Nurkowski | 482/106 |

(Continued)

FOREIGN PATENT DOCUMENTS

EP 1447115 A1 * 8/2004

(Continued)

*Primary Examiner* — Loan Thanh
*Assistant Examiner* — Sundhara M Ganesan
(74) *Attorney, Agent, or Firm* — James W. Miller

(57) ABSTRACT

A selectorized dumbbell has a handle that can be inserted into a gap between stacks of nested left and right weight plates. A selector determines how many left weight plates are coupled to the left end of the handle and how many right weight plates are coupled to the right end of the handle. Each weight plate is held between a pair of flexible arms on a forked carrier. The arms allow the weight plates to deflect out of a normal, substantially upright, orientation if an impact shock is delivered to the dumbbell. The arms are restored to their normal orientation once the impact shock dissipates. Alternatively, the weight plates may comprise a metallic inner weight plate covered with an elastomer encasement and with an integral elastomer lug attaching the weight plates to at least one interconnecting member. The selector may comprise a connecting pin with at least one flexible shock absorbing prong.

5 Claims, 10 Drawing Sheets

U.S. PATENT DOCUMENTS

| | | | | |
|---|---|---|---|---|
| 5,443,435 | A * | 8/1995 | Wilkinson | 482/74 |
| 5,769,762 | A | 6/1998 | Towley, III et al. | |
| 5,788,608 | A * | 8/1998 | Wilkinson | 482/51 |
| 6,083,144 | A * | 7/2000 | Towley et al. | 482/107 |
| 6,422,979 | B1 * | 7/2002 | Krull | 482/98 |
| 6,629,910 | B1 * | 10/2003 | Krull | 482/98 |
| 6,676,575 | B1 * | 1/2004 | Mayo | 482/104 |
| 6,733,424 | B2 * | 5/2004 | Krull | 482/98 |
| 6,758,795 | B2 * | 7/2004 | Barber | 482/106 |
| 6,770,016 | B1 * | 8/2004 | Anderson et al. | 482/106 |
| 6,974,405 | B2 * | 12/2005 | Krull | 482/107 |
| 7,052,445 | B2 * | 5/2006 | Ekhaus | 482/93 |
| 7,153,244 | B2 * | 12/2006 | Towley et al. | 482/108 |
| 7,238,147 | B2 * | 7/2007 | Mills et al. | 482/106 |
| 7,264,578 | B1 * | 9/2007 | Krull | 482/108 |
| 7,278,898 | B2 * | 10/2007 | Kim et al. | 446/473 |
| 2002/0055426 | A1 * | 5/2002 | Krull | 482/98 |
| 2004/0162198 | A1 * | 8/2004 | Towley et al. | 482/107 |
| 2004/0198569 | A1 * | 10/2004 | Sanford-Schwentke et al. | 482/108 |
| 2005/0233873 | A1 * | 10/2005 | Chen | 482/107 |
| 2006/0035767 | A1 * | 2/2006 | Ekhaus | 482/108 |
| 2006/0205565 | A1 * | 9/2006 | Feldman et al. | 482/8 |

FOREIGN PATENT DOCUMENTS

| | | | |
|---|---|---|---|
| JP | 2004243123 | A * | 9/2004 |

* cited by examiner

SELECTORIZED DUMBBELL HAVING A SELECTOR COMPRISING A PIN HAVING FORK-SHAPED CONNECTING PRONG(S)

CROSS REFERENCE TO RELATED APPLICATIONS

This application is a division of application Ser. No. 11/888,270 filed Jul. 31, 2007, now U.S. Pat. No. 7,775,947 which is a continuation-in-part of application Ser. No. 11/498,314 filed Aug. 2, 2006 now U.S. Pat. No. 7,771,330.

TECHNICAL FIELD

This invention relates to a selectorized dumbbell having a selector that the user manipulates to adjust the mass of the dumbbell by coupling desired numbers of weight plates to opposite ends of a handle. More particularly, this invention relates to a selectorized dumbbell having a system for absorbing impact shocks on the dumbbell.

BACKGROUND OF THE INVENTION

A full set of traditional dumbbells has various pairs of dumbbells with different mass, e.g. a pair of 5 pound dumbbells, a pair of 10 pound dumbbells, and so on. Such dumbbells are used for weight training exercises such as biceps curls, triceps extensions, etc. Different users will use whatever size dumbbells are most suited to their particular physical condition and exercise needs. For example, one user might lift 10 pound dumbbells while another user might lift 50 pound dumbbells.

Such a dumbbell set is both costly to purchase and requires a fair amount of storage space. Storage racks are needed simply to store the various pairs of dumbbells. As a practical matter, individuals and small gyms or exercise clubs may not be able to afford either the money or the storage space required for a full set of traditional dumbbells.

Selectorized dumbbells overcome the cost and space obstacles presented by traditional dumbbells. In a selectorized dumbbell, a plurality of weights are nested together. The weights provide a stack of nested left weight plates and a stack of nested right weight plates. The left and right stacks of weight plates are separated from one another by a gap.

In a selectorized dumbbell, a handle is inserted into the gap between the left and right stacks of weight plates. A selector is then manipulated to determine how many of the left and right weight plates of the weights are coupled to the left and right ends of the handle. Once the selector is positioned to pick up a selected number of weights, the handle can then be lifted by the user from between the stacks of weight plates. The selected number of weights will rise with the handle to be used in performing various exercises with the dumbbell.

The obvious advantages of selectorized dumbbells are the cost and space savings provided to the purchaser. Only two dumbbells need be purchased and not an entire set. Yet, these two dumbbells can provide a wide range of exercise mass depending upon how many of the nested weights are coupled to the handle by the selector. Moreover, the only storage space required is that needed for two dumbbells and the nested weights that accompany them. All of this can be stored on a small rack that takes up only a few square feet of floor space. Thus, a single pair of selectorized dumbbells provides an economical alternative to a full set of traditional dumbbells.

The various weights of a selectorized dumbbell must nest inside one another in a smooth and reliable fashion. In addition, the selector coacts with portions of the weights so as to be able to pick up different numbers of weights when the selector is moved between different positions. This requires that the weights, selector and handle all remain aligned within fairly close tolerances. If these tolerances are not maintained, then the selector or the weights may jam and prevent use of the selectorized dumbbell.

While traditional dumbbells are fairly impervious to damage, this is not the case for the more complicated and sophisticated structure of selectorized dumbbells. The weights of a selectorized dumbbell are sometimes dropped onto a floor. This might happen with just a single weight that gets knocked off a rack. Or the user can accidentally drop an entire dumbbell loaded with one or more of the weights onto the floor. In any event, if this happens from higher than about two feet, the weights of the dumbbell can be bent or misaligned or various components of the selector can become bent, misaligned or damaged.

Many weights used in a selectorized dumbbell comprise a pair of spaced weight plates welded to a pair of rails. When these weights are bent, most people do not have the welding equipment and experience to repair them. Usually, the bent weights must be replaced. This is done either by the owner of the dumbbell at his or her own expense or by the manufacturer of the dumbbell as part of a warranty claim. Sometimes, the entire dumbbell might have to be replaced if the damage also extends to the selector or the handle.

In addition, other selectorized dumbbells use rigid plastic protrusions on the weights that coact with selectors having metallic or rigid plastic parts. It sometimes happens that the plastic protrusions on the weights or the plastic parts on the selectors break off. Sometimes, the metallic parts on the selectors bend. When this happens, it is generally impossible to repair the damaged parts, particularly when the damage occurs to the broken plastic weight protrusions or plastic selector parts.

Accordingly, it would be an advance in the exercise art to provide a selectorized dumbbell that can absorb impact shocks without significant damage being done.

SUMMARY OF THE INVENTION

One aspect of this invention relates to an adjustable selectorized dumbbell which comprises a plurality of nested weights having a plurality of members that vertically overlie one another in a vertical array. The members are separated by gaps. A handle is provided which the user can grip to hold and manipulate the dumbbell. The handle has a plurality of vertically spaced openings located adjacent the vertical array of members on the weights with the openings being vertically located on the handle such that each member of each weight is vertically straddled by a pair of openings adjacent the gaps above and below each member. A connecting pin has at least one fork-shaped connecting prong with a pair of upper and lower forks. The connecting pin has the upper and lower forks thereof inserted into a pair of vertical openings with the upper and lower forks straddling the member of a particular weight to thereby couple to the handle the weight whose member is straddled along with all other weights whose members lie above the member straddled by the upper and lower forks.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
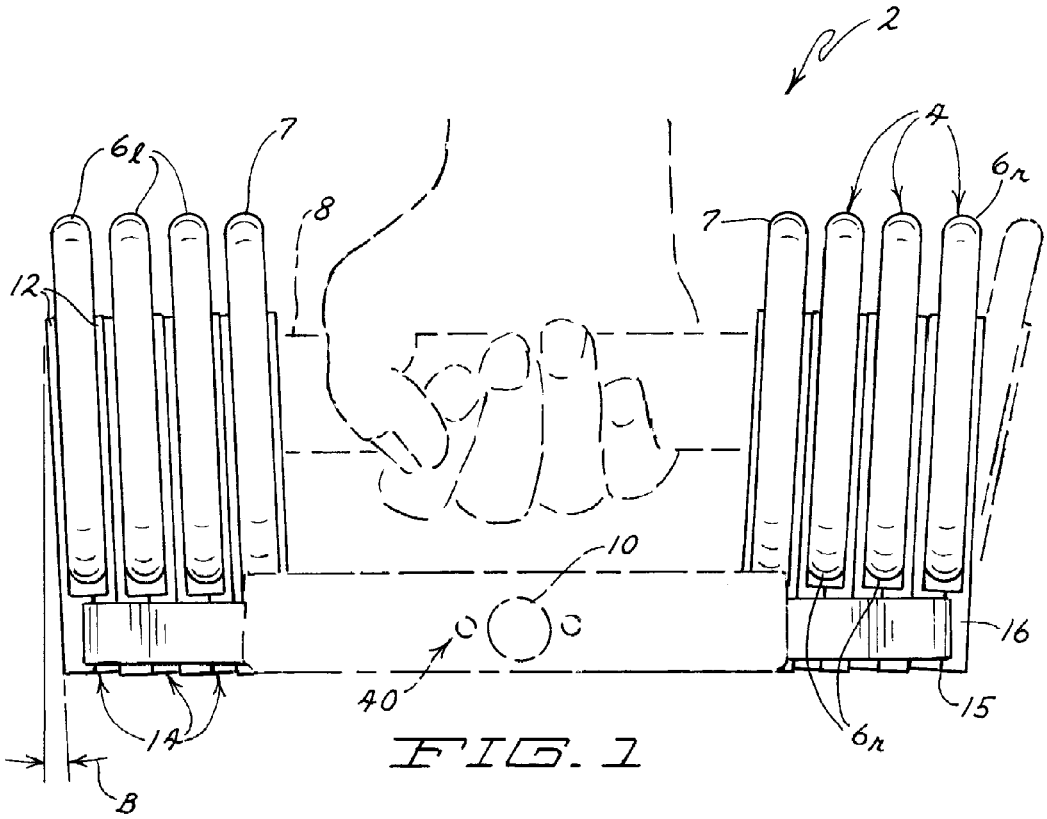
FIG. 1 is a front plan view of one embodiment of a selectorized dumbbell according to this invention.

One embodiment of a selectorized dumbbell according to this invention is illustrated generally as 2 in FIG. 1. Dumbbell 2 is similar to that shown in the Applicants' U.S. Pat. No. 5,769,762, which is hereby incorporated by reference. Dumbbell 2 is also similar to that shown in the Applicants' published U.S. patent application 2004/0162198, which is also hereby incorporated by reference. Only those features of dumbbell 2 which relate to this invention will be described in detail herein. The materials incorporated by reference above can supply other information regarding the general structure and operation of dumbbell 2 in the event the reader hereof desires or requires such information.

Figure 5:
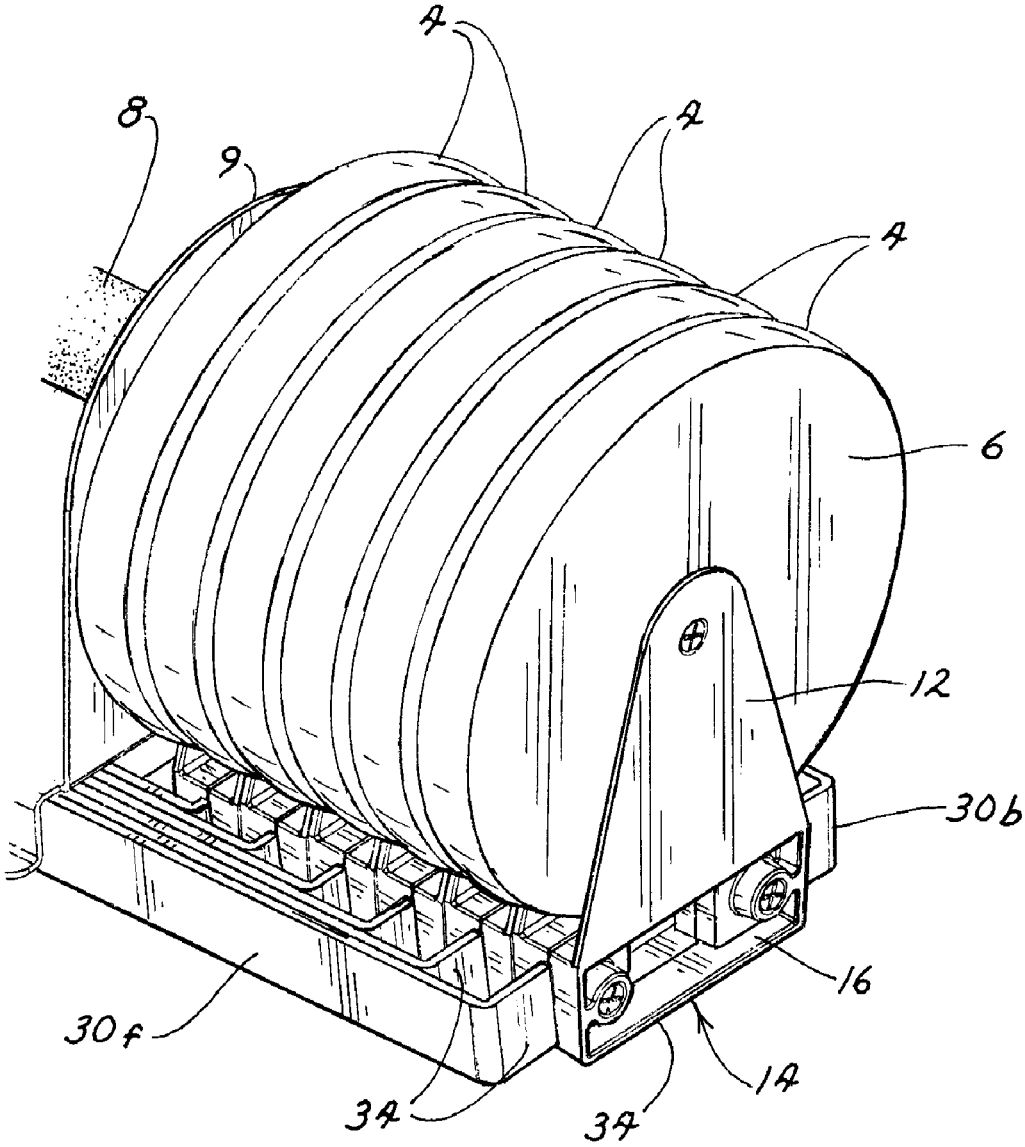
FIG. 5 is a perspective view of one end of a selectorized dumbbell like that of FIG. 1, particularly illustrating a stack of six nested left or right weight plates and how the weight plates and connecting rails in such stack nest together.

Dumbbell 2 is illustrated in FIG. 1 having three nested weights 4. Weights 4 provide a stack of nested left weight plates **6*l* and a stack of nested right weight plates 6*r*. The number of nested weights 4 can obviously vary. For example, dumbbell 2 shown in FIG. 5 has six nested weights 4 that provide six weight plates 6 in each stack of the left or right weight plates 6*l* or 6*r*. If desired, dumbbell handle 8 can also permanently carry a weight plate 7 at each end thereof as shown in FIG. 1. Alternatively, as shown in FIG. 5, each end of handle 8 could simply comprise a side flange 9** that is free of any handle carried weight plates.

Handle 8 is inserted into a gap between the two stacks of nested left and right weight plates **6*l* and 6*r*. The position of a selector 10, such as a pin, determines how many nested weights 4 are coupled to handle 8. This is how a user varies the exercise mass of a selectorized dumbbell 2, namely by adjusting selector 10. Selector 10** can take many shapes, i.e. an insertable pin, a rotary dial, multiple rotary dials, etc.

One aspect of this invention involves the placement of a shock absorbing system somewhere in the combination of nested weights 4, handle 8, and selector 10 that comprise dumbbell 2. The preferred embodiment of this invention places the shock absorbing system in nested weights 4, but this invention is not limited to this specific placement. The shock absorbing system could be placed in handle 8 or in selector 10.

The term "shock absorbing system" as used in this application is defined to mean some type of structure that will deflect, deform or otherwise move from a normal orientation when a shock is applied to dumbbell 2, such as when dumbbell 2 is dropped and hits the floor, and that restores to the normal orientation after the shock has passed through dumbbell 2. This allows dumbbell 2 to absorb impact shocks thereby lessening the risk of damaging dumbbell 2.

Figure 3:
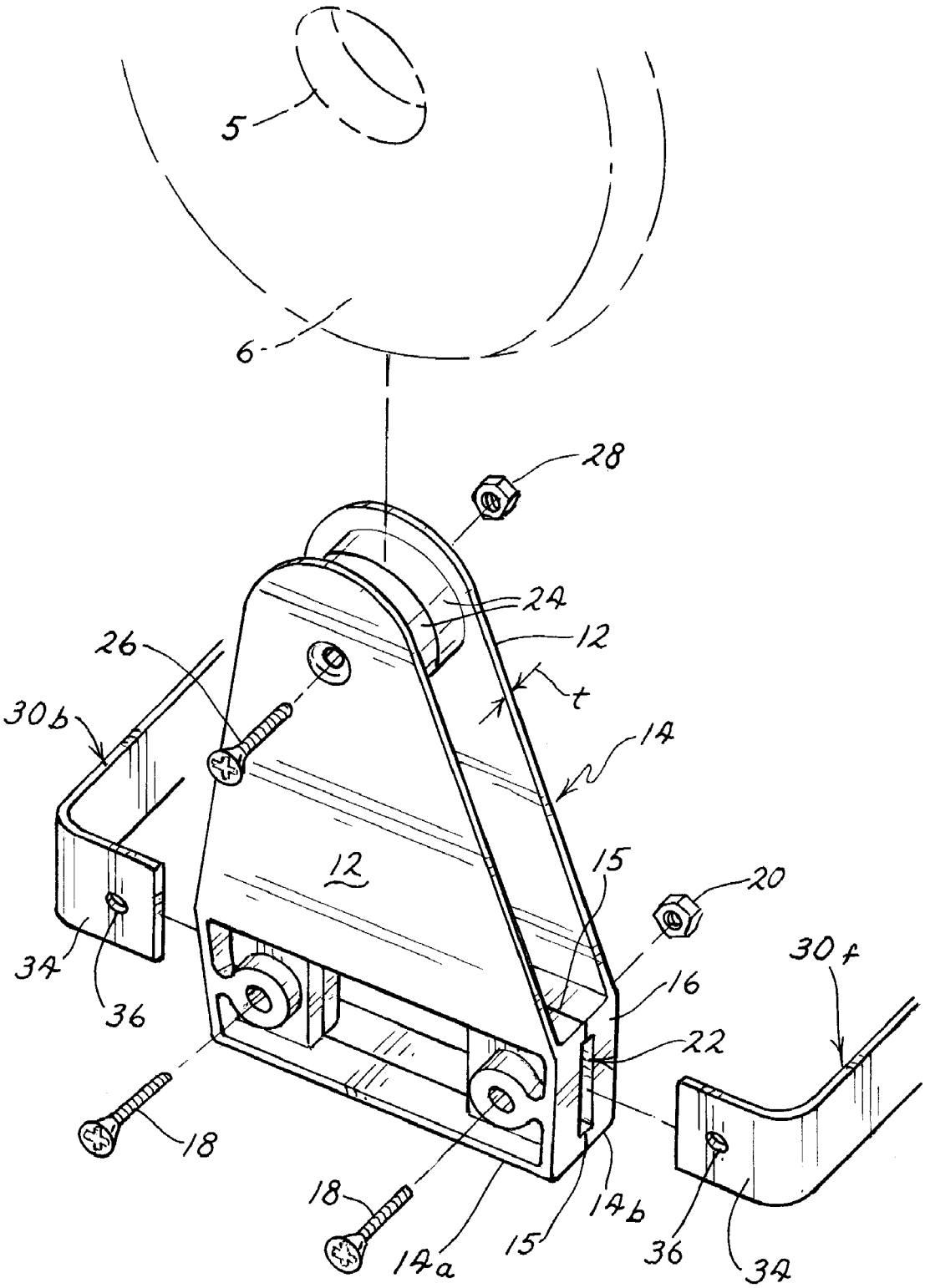
FIG. 3 is a perspective view of one end of one weight of the selectorized dumbbell of FIG. 1, particularly illustrating one of the weight plates of the weight along with the carrier that holds the weight plate to a pair of rails.

Each weight plate 6 in the various weights 4 is held between the arms 12 of a forked carrier 14. As shown in FIGS. 1 and 3, arms 12 extend upwardly from an underlying base 16 of carrier 14. Base 16 of carrier 14 is substantially rigid. Arms 12 taper inwardly as they rise from base 16 of carrier 14 to be generally triangular in shape. Arms 12 are substantially smaller than weight plate 6 carried between arms 12.

Arms 12 of carrier 14 are flexible. This permits arms 12 of carrier 14 and weight plate 6 carried thereby to have a normal, substantially upright orientation as shown in solid lines in FIG. 1. However, if an impact load is applied to dumbbell 2, arms 12 of carrier 14 can deflect to the side as shown in phantom lines in FIG. 1. After the impact load passes, arms 12 in carriers 14 will restore themselves to their normal orientation. Thus, according to the earlier definition herein of the term shock absorbing system, the flexible arms of carriers 14 comprise the shock absorbing system.

While only one carrier 14 holding one weight plate 6 is shown in FIG. 1 as having deflected, such deflection would typically occur on at least some other carriers 14 close to the impact load. The deflection of the other carriers 14 is not shown in FIG. 1 simply for the purpose of clarity in the drawings.

Figure 2:
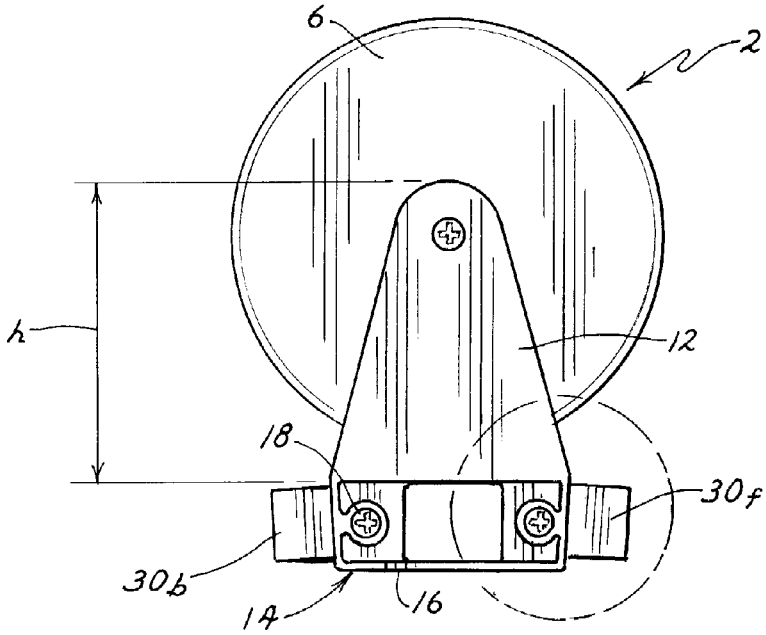
FIG. 2 is a side elevational view of the selectorized dumbbell of FIG. 1.

Arms 12 of each carrier need to be stiff enough to support weight plate 6 in its normal, substantially upright orientation. At the same time, arms 12 need to be flexible enough to bend or flex if dumbbell 2 experiences an impact load, such as might occur if dumbbell 2 bangs against a fixed object or is dropped. The Applicants have found that a carrier 14 made of ultra high molecular weight polyethylene (UHMW-PE) plastic works well. Such UHMW-PE material is sold under trade names such as TUFLAR® manufactured by Keltrol Enterprises, Inc. of York, Pa. or TIVAR® manufactured by Poly Hi Solidur of Fort Wayne, Ind. A carrier 14 with arms that are 4" high, as indicated at h in FIG. 2, and that are between 0.062" and 0.125" thick, as indicated at t in FIG. 3, have the appropriate mixture of stiffness and flexibility for properly supporting a 5 lb. weight plate.

Obviously, the materials used to form arms 12 can be varied. In addition, the shape, height and thickness of arms 12 can also be varied for supporting lighter or heavier weight plates. Since arms 12 are made of a plastic material that is somewhat naturally slick, and since arms 12 are relatively narrow and small compared to the much larger weight plate 6, it is easier to slide one weight 4 up out of a stack or down into a stack. Arms 12 engage and slide over one another much more easily than weight plates 6 would slide over one another if weight plates 6 simply nested directly against one another. Thus, the separation between weight plates 6 provided by arms 12 of carriers 14 is advantageous.

Carriers 14 are made in two halves 14*a* and 14*b* as indicated in FIGS. 1 and 3 by the parting line 15 between halves 14*a*, 14*b*. Each carrier half 14*a* and 14*b* carries one of the flexible arms 12 in each pair of arms 12. Carrier halves 14*a*, 14*b* are secured together by a plurality of attachment bolts 18 and nuts 20 shown in FIG. 3. When secured together, bolts 18 and nuts 20 are recessed within the left and right sides of base 16 of carrier 14 so that they do not project laterally outwardly beyond the left and right sides of base 16 of carrier 14. Carrier halves 14*a*, 14*b* are also formed so as to provide a slot 22 in each of the front and back sides of base 16 of carrier 14 along parting line 15 between carrier halves 14*a*, 14*b*. Each carrier 14 extends perpendicularly relative to the axis of handle 8.

The upper ends of arms 12 of carrier 14 each have an inwardly protruding cylindrical stub shaft 24 for mounting weight plate 6 between arms 12. Stub shafts 24 on the pair of arms 12 protrude partly into a central mounting hole 5 provided in each weight plate 6 from either side of hole 5. Another attachment bolt 26 and nut 28 are provided to secure the upper ends of arms 12 together. When this occurs, stub shafts 24 abut one another to form, in effect, a cylindrical hub. This also holds weight plate 6 between arms 12 with hole 5 of weight plate 6 being concentrically received on the hub formed by stub shafts 24 on arms 12 of carrier 14. Again, the head of attachment bolt 26 and nut 28 are seated in recesses in arms 12 so that the attachment bolt and nut do not protrude beyond the outer faces of arms 12.

Each nested weight 4 preferably comprises a pair of carriers 14 and a pair of weight plates 6, namely a first carrier 14 carrying left weight plate 6*l* and a second carrier 14 carrying right weight plate 6*r*. Weight plates 6 comprising each weight 4 are laterally spaced apart from one another. A pair of interconnecting members comprising a front rail 30*f* and a back rail 30*b* unite or join the laterally spaced apart weight plates 6 together. The front and back rails 30 used in different weights 4 have progressively increasing lengths as one proceeds from the inner to the outer weights 4 in each stack. This progressively increases the spacing between the left and right weight plates 6*l* and 6*r* in each weight 4 to allow the different weights 4 to be nested together. Rails 30 comprise strap like steel rails having a substantially flat cross-sectional profile.

Opposite ends of rails 30 are easily bent into an L-shape to provide inturned ends 34. Ends 34 are received in slots 22 formed along the parting lines 15 between carrier halves 14*a*, 14*b*. Each inturned end 34 includes an opening 36 for allowing one of the attachment bolts 28 that secure carrier halves 14*a*, 14*b* together to pass through the end 34 of rail 30. Like the lengths of rails 30, inturned ends 34 of rails 30 progressively increase in depth from rails 30 used on the inner to the outer weights 6 in each stack. This allows rails 30 of the different weights 4 to nest inside one another as shown in FIG. 5.

Figure 4:
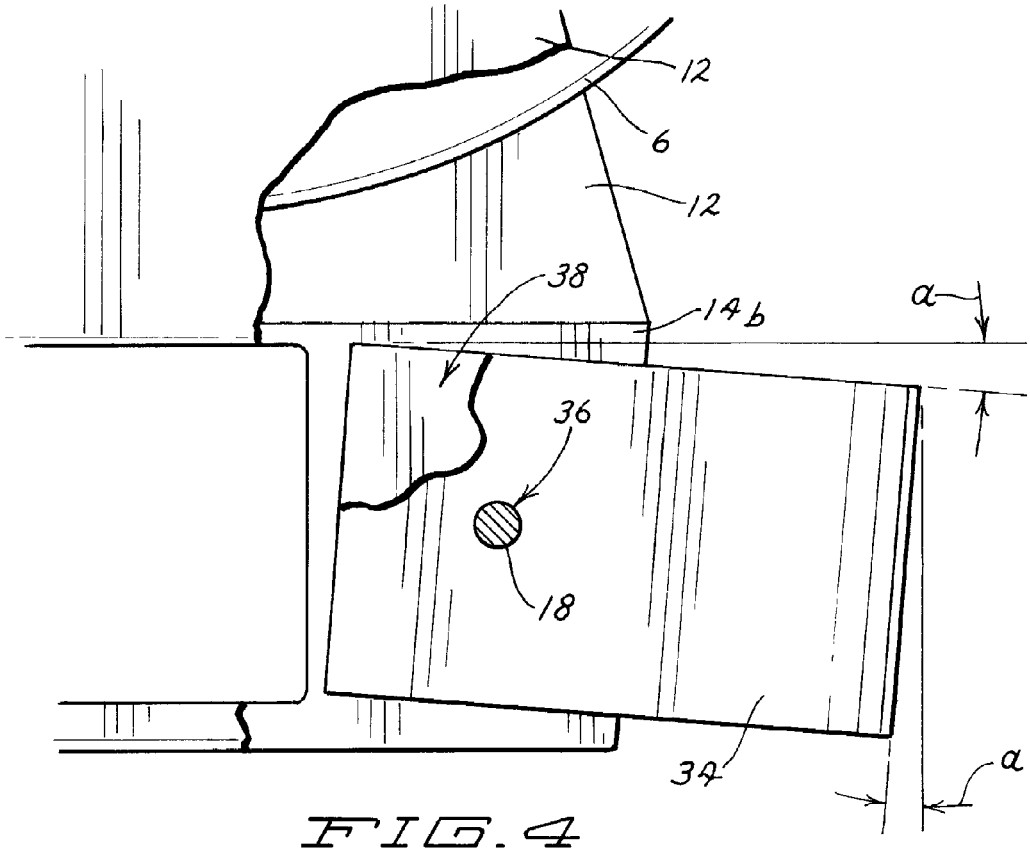
FIG. 4 is an enlarged, partially broken away, side elevational view of the circled portion of FIG. 2, particularly illustrating the attachment of one of the connecting rails to the base of the carrier.

Referring to FIG. 4, inturned ends 34 of rails 30 are each received in a molded pocket 38 in each carrier half 14*a* or 14*b*. Pocket 38 in carrier half 14*a* forms one half of slot 22 and an identical pocket 38 in carrier half 14*b* forms the other half of slot 22. Pocket 38 is angled slightly downwardly relative to a horizontal line as indicated by the angle α in FIG. 4. This positions the main body of rail 30, namely the long section of rail 30 extending between inturned ends 34, at a corresponding angled inclination extending from top to bottom. In other words, the top of rail 30 is angled outwardly relative to the bottom of rail 30 by the same angle α, also as shown in FIG. 4. Preferably, à is quite small, approximately 3° or so.

In addition, arms 12 of carriers 14 are molded to base 16 in such a way that arms 12 of carriers 14 also angle outwardly towards the outer side of dumbbell 2 as they extend upwardly. In other words, when carrier halves 14*a*, 14*b* are bolted together on inturned ends 34 of the front and back rails 30, arms 12 of carriers 14 used to hold the left weight plates 6*l* will angle outwardly towards the left and arms 12 of carriers 14 used to hold the right weight plates 6*r* will angle outwardly towards the right. This is shown by the angle β in FIG. 1. The angle β is also approximately 3°.

The angles α and β permit weights 4 to separate from or nest down inside one another more easily when handle 8 is lifted out of or lowered down into the gap between the stacks of weight plates 6. The outward inclination of the main bodies of rails 30 provided by the angle à serves to guide rails 30 together when those weights 4 carried on handle 8 are dropped down into the other weights 4 remaining on a rack (not shown). FIG. 5 shows how the main bodies of rails 30 nest inside one another when weights 4 are nested together. Similarly, the outward inclination of weight plates 6 provided by the angle α serves a similar function in allowing weight plates 6 to be more easily separated from one another or nested back together.

The angles α and β are not new to this invention but can be found in prior art selectorized dumbbells manufactured by the assignee of this invention. However, the angles α and β are easily and inexpensively provided in carrier 14 in the molding process. For example, the angle α is provided simply by inclining the molded pockets 38 in carrier halves 14*a*, 14*b* downwardly at the desired angle α. Similarly, the angle β is provided by molding arms 12 at a slight angle relative to base 16 of carrier 14.

Each weight 4 has a weight selection section, shown generally as 40 in FIG. 1, which coacts with selector 10 to determine which weights 4 are picked up by handle 8 and which are not. The nature of weight selection section 40 varies with the nature of selector 10. When selector 10 comprises an insertable pin, weight selection section 40 can comprise various unique sets of holes and slots provided in rails 30 that will pick up different numbers of weights 4 depending upon which set of holes and slots is used to receive the pin. See U.S. Pat. No. 5,769,762. However, the specific selector and the specific nature of weight selection section 40 of weights 4 can vary and do not form part of this invention.

Essentially, in each weight 4, the rigid bases 16 of each carrier 14 are rigidly secured to steel rails 30. Together, carriers 14 and rails 30 form a weight frame for holding a plurality of weight plates 6. A part of this weight frame is rigid, namely the part comprised of the rigid bases 16 of carriers 14 and the rigid rails 30 to which bases 16 are bolted. Another part of this weight frame is flexible, namely the part comprising the various flexible arms 12 of carriers 14.

Users can and often do drop either an individual weight 4 or an entire selectorized dumbbell 2 loaded with a number of weights 4 onto the floor. With dumbbell 2 of this invention, the shock absorbing system incorporated into weights 4 will absorb many of these impact shocks by causing arms 12 of carriers 14 to deflect. Arms 12 of carriers 14 will reset or restore themselves after the impact shock is over, often without damaging any portion of dumbbell 2. At the very least, the shock absorbing system of this invention greatly minimizes both the chances for damage to occur as well as the degree of damage should any damage occur at all.

In addition, if some damage occurs to weights 4 of dumbbell 2 despite the presence of the shock absorbing system formed by flexible arms 12 of carriers 14, such damage often takes the form of bent rails 30. With weights 4 of dumbbell 2 of this invention, it is easy to disassemble any particular weight 4 simply by unscrewing carrier halves 14*a*, 14*b* of each carrier to free rails 30. Rails 30 can then be removed and replaced. Alternatively, if rail 30 is just bent, it would also be possible to use a hammer and a vise to simply straighten out any unwanted bends in rail 30. Once rail 30 is straightened, it can be easily replaced between carrier halves 14*a*, 14*b* and carrier halves 14*a*, 14*b* can be secured together once again to grip inturned ends 34 of rails 30 between them.

As a result of all of the above, dumbbell 2 of this invention will be less prone to being damaged than prior art selectorized dumbbells. This will increase user satisfaction by decreasing the times when the user is not able to use selectorized dumbbell 2 because it has been damaged. In addition, warranty costs to the manufacturer will be decreased, thus increasing the manufacturer's profit margins. The manufacturer will also enjoy the increased goodwill that will come from having a more reliable product in operation.

Flexible arms 12 of carriers 14 comprise only one shock absorbing system that could be used. Instead, arms 12 could be rigid like base 16, but could then be connected to base 16 by a live hinge that functions as the shock absorbing system. Alternatively, a pair of rigid arms 12 could be pivotally attached to base 16 by a pivot pin for side-to-side pivoting and a plurality of springs could be used to center arms 12 on base 16 and to oppose the pivoting motion of arms 12.

Moreover, as mentioned earlier, the location of the shock absorbing system is not confined to carriers 14 used to carry weight plates 6 or to the type of selectorized dumbbell 2 as shown herein.

For example, as shown in FIG. 4 of the 762 patent incorporated by reference above, dumbbell 2 could be of the type in which the spaced left and right weight plates of each weight are connected together by a pair of rails, namely a front and back side rail. The rails are metallic and are welded at their ends to the front and back sides of the left and right weight plates. Moreover, the rails for different weights are at different elevations and overlie one another in a vertically spread apart array.

In this type of dumbbell 2, the selector comprises a double pronged connecting pin. The connecting pin is selectively inserted beneath the rails for any particular weight in the set of nested weights. This is done by sliding the two prongs of the connecting pin into two slots in a set of vertically spaced slots carried on each vertical end of the handle. Each prong slides into the slot on one end of the handle so that the prongs pass beneath the rails of the selected weight. Then, when the user picks up the handle, the handle carries with it the weight having the rails that are engaged by the prongs of the connecting pin as well as all the weights whose rails lie above the rails of the selected weight.

To incorporate a shock absorbing system in this type of dumbbell 2, the shelves that form the slots on each end of the handle could simply be molded of a resilient material. This material could be rubber or some other resilient elastomeric or plastic material. The resilient material would be stiff enough to not deform under normal use of dumbbell 2, but would deform and absorb shock if dumbbell 2 were dropped. In such a dumbbell, the use of a handle having fully or partially resilient ends would prevent damage to the prongs of the connecting pin which are normally made of a metallic material such as stainless steel.

Or, in such a dumbbell 2, handle 8 could have rigid ends with rigid prong receiving slots as is normally the case. Instead, selector 10 could be manufactured at least partially of a shock absorbing material, such as the UHMW-PE described above. For example, each prong of the connecting pin or the entire connecting pin including both prongs could be molded out of UHMW-PE. In this event, the prongs of the connecting pin would bend and then restore themselves if an impact load is felt by dumbbell 2. ®MDIN⁻

Figure 6:
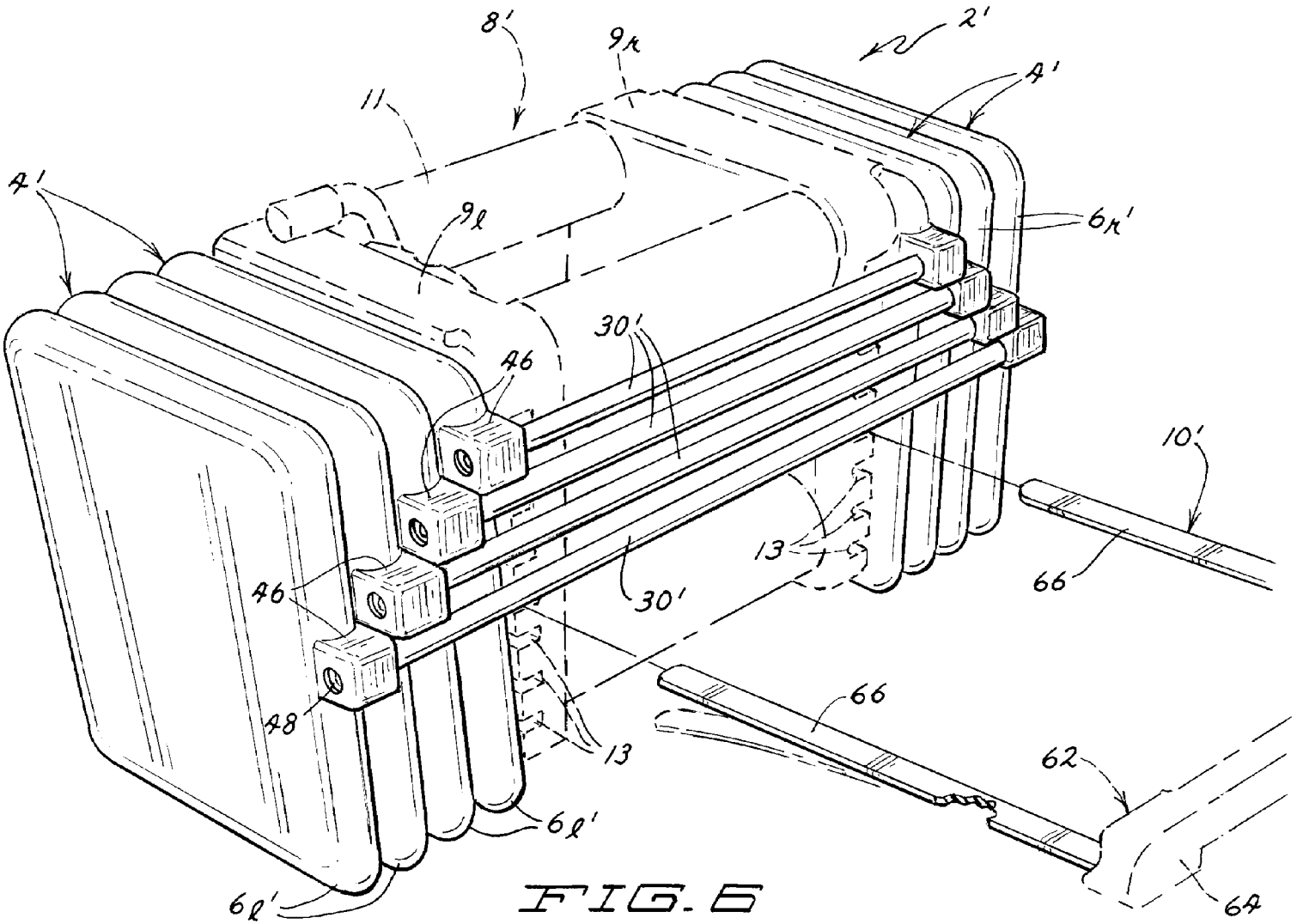
FIG. 6 is a perspective view of another embodiment of a selectorized dumbbell according to this invention, particularly illustrating a dumbbell in which the weights are selectively coupled to the handle by a shock absorbing selector and in which the weights have spaced left and right weight plates with each left and right weight plate comprising an inner weight plate having an elastomer encasement.

FIG. 6 shows a selectorized dumbbell 2' of the general type mentioned in the last four paragraphs. In dumbbell 2', handle 8', depicted in phantom, has a pair of opposite left and right ends 9*l* and 9*r* that are connected together by spacers or cross tubes 11. The user can drop his hand down between the two upper cross tubes 11 to grip a hand grip (not shown) that extends between the ends 9*l* and 9*r* of handle 8' parallel to cross tubes 11. The hand grip connects to the laterally spaced ends 9*l* and 9*r* of handle 8' approximately at the center of the ends 9*l* and 9*r* of handle 8'.

Each end 9*l* and 9*r* of handle 8' has a vertical array of slots 13 that traverse across the end 9*l* and 9*r* of handle 8' from the front to the back of handle 8'. Slots 13 are substantially horizontal grooves or shelves cut or formed into the ends 9*l* and 9*r* of handle 8'. Slots 13 are adapted to receive a pair of horizontal prongs on a selector 10' that is used to adjust how many weights are attached to handle 8'.

Each weight 4' of dumbbell 2' includes a left weight plate 6*l'* and a right weight plate 6*r'* that are connected together by a pair of interconnecting members, namely by a pair of side rails 30', 32'. Four such weights 4' are shown in dumbbell 2' depicted in FIG. 6. Only the front side rail 30' is shown in FIG. 6. A similar rear side rail 32' is used on the rear side of dumbbell 2' in FIG. 6 but is not visible in FIG. 6. Both the front and rear side rails 30' and 32' can be seen in FIG. 7. The structure of dumbbell 2' described thus far corresponds generally to the prior art dumbbell known as the PowerBlock and to the dumbbell shown in FIG. 4 of the 762 patent.

Preferably, dumbbell 2' shown in FIG. 6 includes weight plates 6*l'* and 6*r'* that comprise a two-part construction, namely a metallic inner weight plate 42 and an outer elastomer encasement 44. Elastomer encasement 44 preferably completely encloses inner weight plate 42, but this need not necessarily be the case. For example, elastomer encasement 44 could extend only around the peripheral edges of inner weight plate 42 with the central portion of inner weight plate 42 being exposed. However, whether the entire inner weight plate 42 is encased or only portions of inner weight plate 42 are encased, the elastomer encased inner weight plates 42 are less noisy when being used and are less prone to marking or scratching any surface onto which dumbbell 2' might be laid.

Different materials could be used to form elastomer encasement 44. One preferred material is polyurethane. However, rubbers or vinyls could be used instead as well as other materials.

Figure 7:
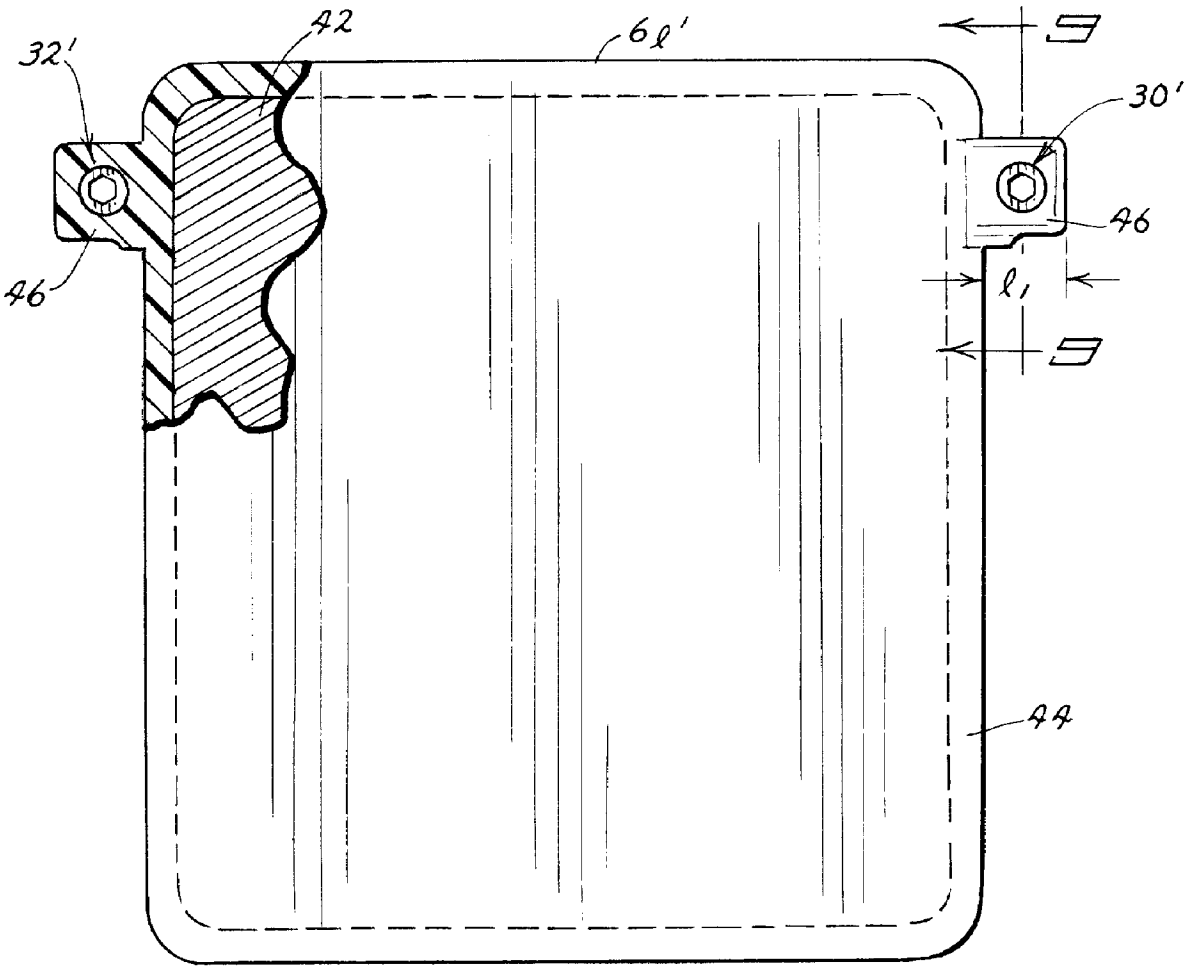
FIG. 7 is a side elevational view of one of the weight plates of the weights of the dumbbell shown in FIG. 6, particularly illustrating one of the elastomer encased inner weight plates with a portion of the elastomer encasement having been removed to expose the inner weight plate.

Each of the substantially vertical front and back edges of elastomer encasement 44 preferably includes an integrally formed or molded, horizontally outwardly extending, elastomer attachment lug 46. Lugs 46 on the weight plates 6*l*' and 6*r*' of a given weight 4' will be at the same vertical height as shown in FIG. 7 so that side rails 30', 32' of a given weight 4' will be at the same height.

As can be seen in FIG. 6 and as is true of the known PowerBlock selectorized dumbbells on the market, side rails 30', 32' of adjacent weights 4 are located progressively lower as the distance between the weight plates 6*l*' and 6*r*' increases to allow the individual weights 4' to nest together as shown in FIG. 6. Thus, lugs 46 will be at progressively lower heights on different weights 4' to achieve the same effect. For example, looking at FIG. 6, one can easily see that lugs 46 on the four different weights 4' are progressively lower from one weight to the next to allow side rails 30', 32' to be in a vertically disposed or stacked array similar to that of rails 30', 32'. Lugs 46 are also designed with a height that allows them to rest atop the side rails 30', 32' of the adjacent lower weight 4' substantially immediately inboard of lugs 46 on the adjacent lower weight 4' when weights 4' are nested together. See FIG. 6.

Figure 8:
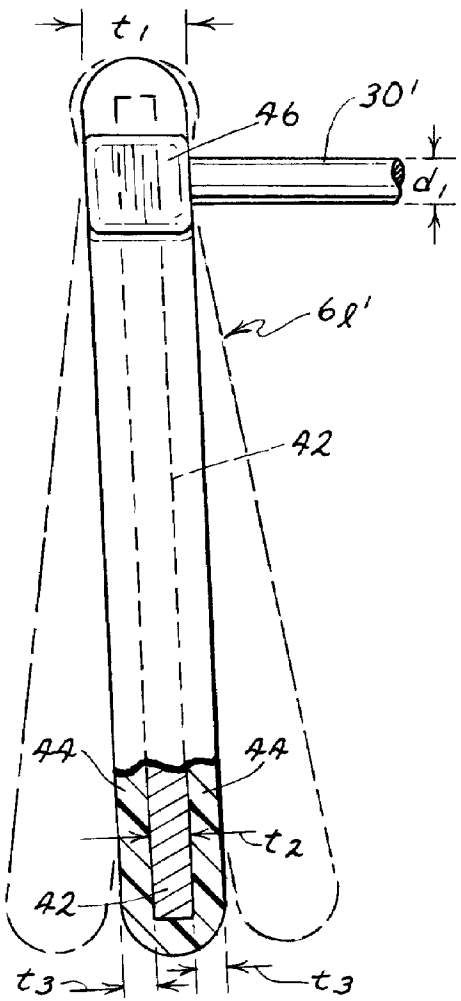
FIG. 8 is a front elevational view of the weight plate shown in FIG. 7.

Referring to FIG. 8, each lug 46 desirably has a thickness t1 that generally corresponds to the overall thickness of weight plate 6' itself, i.e. to the thickness t2 of inner weight plate 42 combined with the thicknesses t3 of those portions of elastomer encasement 44 that cover the opposite left and right faces of inner weight plate 42. In addition and referring to both FIGS. 7 and 8, lugs 46 have an outwardly extending length 11 that is somewhat larger than an outer diameter d1 of side rails 30', 32'. Lugs 46 are bored to provide a horizontal, through passageway 48 therein which extends in the direction of elongation of side rails 30', 32' with passageway 48 extending completely through the thickness t1 of lug 46. Lug 46 and passageway 48 form part of the attachment for side rail 30' or 32'.

Preferably, passageway 48 is inclined at a small angle of approximately 3ø or so in order that each weight plate 6*l*' and 6*r*' tilts slightly outwardly as it extends upwardly. This aids in nesting the left and right weight plates 6*l*' and 6*r*' together in the same manner as discussed with respect to the embodiment of FIGS. 1-5. In this regard, note the description of angled pocket 38 above and the angle denoted as à in FIG. 4.

Figure 9:
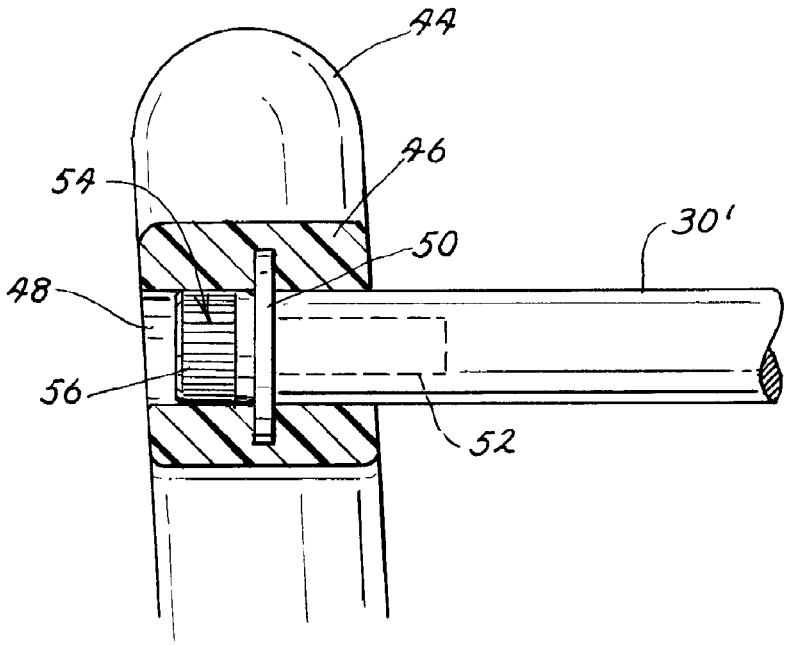
FIG. 9 is a cross-sectional view taken along lines 9-9 in FIG. 7, particularly illustrating a first attachment between one end of a side rail and an elastomer attachment lug extending outwardly from the elastomer encasement as part of the encasement.

Referring now to FIG. 9, a first attachment for side rail 30' or 32' comprises a circular washer 50 that is centrally embedded in lug 46 when lug 46 is formed. The central opening (not shown) in washer 50 has a diameter less than the diameter of passageway 48 such that washer 50 provides an annular, inwardly protruding abutment inside passageway 48 for the end of side rail 30' or 32'. In other words, the end of side rail 30' or 32' extends into passageway 48 until the end of side rail 30' or 32' abuts against the portion of washer 50 that protrudes inwardly into passageway 48. The end of side rail 30' or 32' has a threaded bore 52 therein that is slightly smaller in diameter than the diameter of the central opening in washer 50.

A threaded fastener 54, such as a machine bolt, is then inserted into passageway 48 in lug 46 from the other side of passageway 48 and is tightened into threaded bore 52 in the end of side rail 30' or 32'. The shank of fastener 54 is small enough to pass through the central opening of washer 50. The head 56 of fastener 54 will eventually abut against washer 50 when fastener 54 is tightened. When fastener 54 is tightened, the end of side rail 30' or 32' is firmly affixed to lug 46 by virtue of the encased washer 50 and the use of fastener 54 to clamp side rail 30' or 32' against washer 50.

Use of an encased washer 50 as shown in FIG. 9 is preferred since the attachment does not protrude outside of the thickness t1 of lug 46 and thus allows more compact nesting of the weights 4'. However, if desired, washer 50 and the head 56 of fastener 54 could be externally located on the outer face of lug 46 keeping in mind that the length of the weight 4' is now longer by the thickness of washer 50 and by the length of the head of fastener 54.

Figure 10:
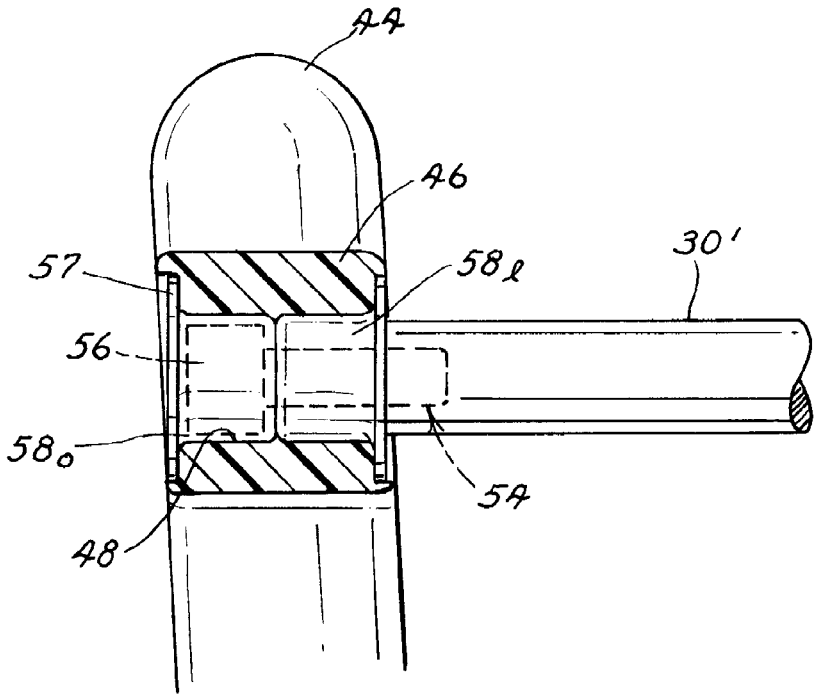
FIG. 10 is a cross-sectional view similar to FIG. 9, particularly illustrating a second attachment between the side rail and the elastomer attachment lug.
Figure 11:
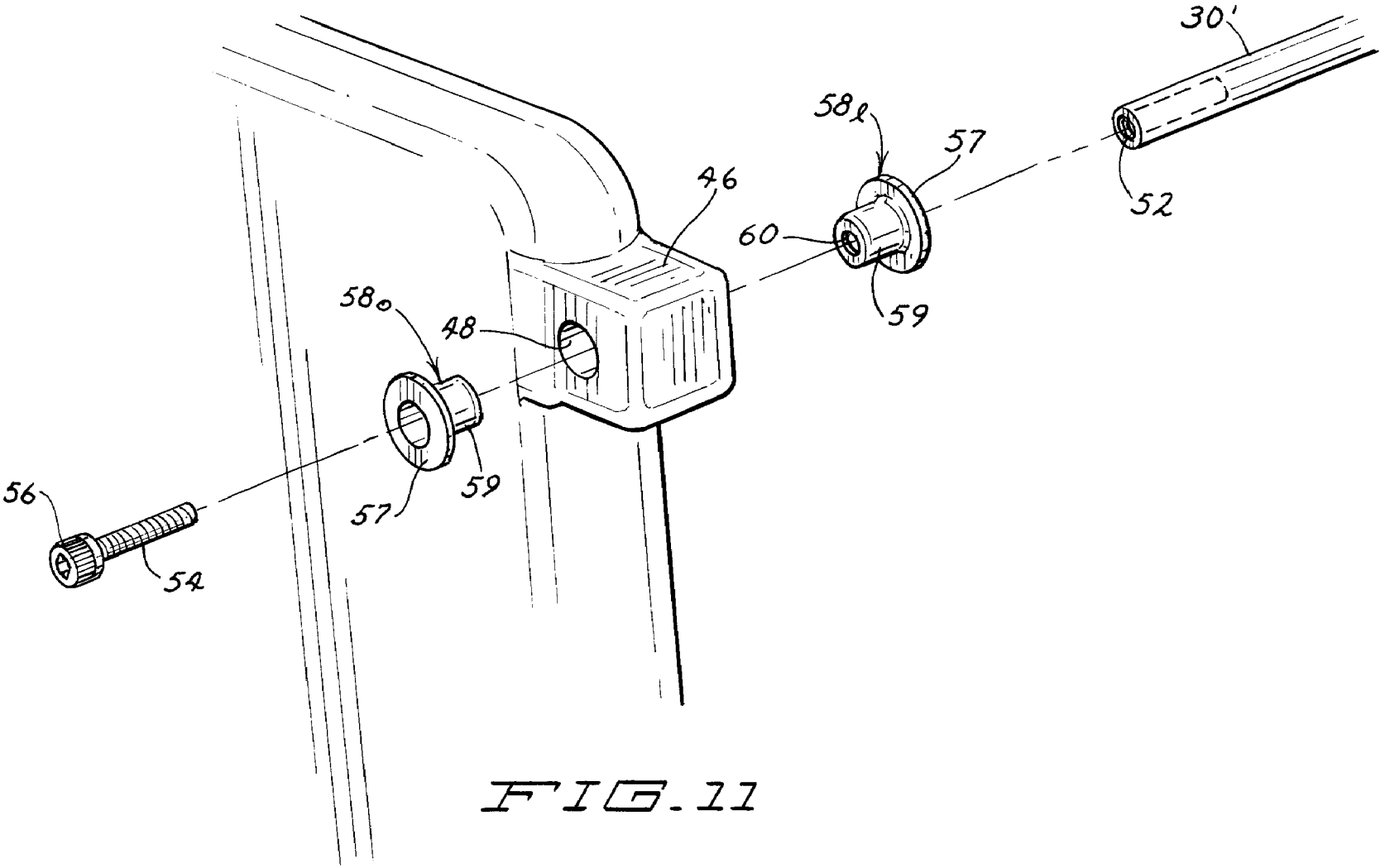
FIG. 11 is an exploded, perspective view of the second attachment shown in FIG. 10.

FIGS. 10 and 11 show an alternative attachment for coupling the end of side rail 30' or 32' to lug 46. In this attachment, two metallic bushings 58*i* and 58*o* having cylindrical, cup-shaped hubs 59 with bottoms 60 are press fit with a snug fit into each side of passageway 48 in lug 46 after lug 46 is formed. The end of side rail 30' or 32' is inserted into hub 59 on inner bushing 58*i* and fastener 54 is inserted into hub 59 on outer bushing 58*o*. When fastener 54 is tightened in threaded bore 52 in the end of side rail 30' or 32', fastener 54 will draw side rail 30' or 32' firmly into engagement with bottom 60 of hub 59 on inner bushing 58*i* until the head 56 of fastener 54 has similarly firmly engaged bottom 60 of hub 59 on outer bushing 58*o*. Thus, side rail 30' or 32' is firmly attached to lug 46, but without having to embed bushings 58*i* or 58*o* in lug 46 prior to formation of elastomer encasement 44. Each opposite face of lug 46 has a slight recess to accommodate the thickness of the flange portion 57 of bushings 58*i* and 58*o*.

Preferably, elastomer encasement 44 used to encase inner weight plates 42 and to provide the attachment lugs 46 is relatively soft as elastomer materials go. For example, when elastomer encasement is formed of polyurethane, a polyurethane that is preferably less than 100 on the Shore A scale and approximately 80 to 85 on the Shore A scale can be used. This provides weight plates 6' with a shock absorbing quality since shocks applied to dumbbell 2' will often cause the weight plates 6' to attempt to torque or pivot about the attachment to side rails 30', 32', as illustrated in phantom in FIG. 8. In effect, lugs 46 act as flexible joints that are able to twist or deform in response to a shock. Such deformation builds up a biasing force in lugs 46 tending to restore lugs 46 to their usual orientation when the shock passes and the weight plates 6' are no longer being frictionally held in their twisted orientation, i.e. after the weight 4' is picked up from the floor for example. Thus, when elastomer encasement 44 of inner weight plate 42 is sufficiently soft and with lugs 46 of the type shown herein, lugs 46 of elastomer encasement 44 can constitute the shock absorbing system (or at least one portion of a shock absorbing system).

Instead of using an elastomer encasement 44 around an inner metallic weight plate 42, each weight plate 6' could simply comprise a metallic weight plate 42 in which lugs 46 are integrally formed metallic lugs on weight plate 42, i.e. encasement 44 would be gone. In this design, bushings 58*i* and 58*o* and the attachment of FIGS. 10 and 11 could be used, except that bushings 58*i* and 58*o* would now be formed of a relatively soft elastomer, such as the soft polyurethane disclosed above for use in elastomer encasement 44. Such elastomer bushings would develop a restoring force if the weight plates 6' were torqued or twisted relative to side rails 30' or 32'. Elastomer bushings 58*i* and 58*o* would now comprise a flexible, shock absorbing joint between weight plates 6' and side rails 30' or 32'. However, such an alternative design is not preferred as the noise deadening and scratch resistant properties of elastomer encasement 44 would be absent.

As shown in FIG. 6, selector 10' itself can also comprise the shock absorbing system or at least another portion of the shock absorbing system that works in concert with elastomer lugs 46. In selector 10' shown in FIG. 6, selector 10' comprises a U-shaped connecting pin 62 having a relatively rigid base 64 made from a hard plastic or metallic material. Each end of base 64 includes an inwardly extending, substantially horizontal connecting prong 66. Each prong 66 is adapted to fit or slide into one of slots 13 in each end of handle 8' beneath one of side rails 30', 32' of a given weight. When connecting pin 62 is so inserted, prongs 66 will lift up on side rails 30', 32' of the weight 4' beneath which pin 62 was inserted to couple that weight 4' and all the weights 4' above the selected weight 4' to handle 8'. That is how the weight of dumbbell 2' is selectively adjusted by the user.

Now, there is nothing novel about the shape of pin 62 shown in FIG. 6 or how pin 62 fits into slots 13 on the ends of handle 8' or interacts with side rails 30', 32' of weights 4'. This is a selector known in the prior art PowerBlock dumbbell and again this type of selector is shown in FIG. 4 in the 762 patent. What is different in selector 10' of this invention is that prongs 66 of pin 62 are flexible relative to base 64 with prongs 66 being made of UHMW-PE. Now, when dumbbell 2' experiences an impact shock, prongs 66 of pin 62 are able to bend and ultimately to restore themselves to their usual shape without breaking. Thus, at least part of pin 62 itself, namely flexible prongs 66 thereof, is also part of the shock absorbing system. This will lead to lower warranty and repair costs since pins 62 are not as prone to being bent or broken, i.e. prongs 66 of pin 62 will bend and restore without breaking.

In dumbbell 2' shown in FIG. 6, the shock absorbing system can be comprised both of the polyurethane attachment lugs 46 along with the flexible connecting prongs 66 of connecting pin 62. However, it would be possible to form the weights of dumbbell 2' with a very hard elastomer or non-elastomer encasement 44 in which the attachment lugs 46 do not really bend or twist in response to a shock or impact and thus do not develop any significant restoring forces. Encasement 44 in this embodiment only serves a noise deadening, scratch resistant function. For example, this might be true for a weight in which polyurethane encasement 44 is higher than 50 on the Shore D scale. Alternatively, the weights of dumbbell 2' could have no encasement and simply comprise metallic weight plates with outwardly protruding metallic lugs. In these cases, only the flexible prongs 66 of connecting pin 62 will form the shock absorbing system.

When a connecting pin as shown in FIG. 6 with a single pair of flexible UHMW-PE connecting prongs 66 are used, the connecting prongs 66 have to be relatively wide, i.e. on the order of 1" or so, to have sufficient strength to lift and couple the weights 4' to handle 8'. This is a disadvantage as it lengthens the overall length of handle 8' since slots 13 in handle 8' have to be wider as well. As a result, dumbbell 2' is longer than when a conventional pin 62 with circular metal prongs 66 is used.

Figure 12:
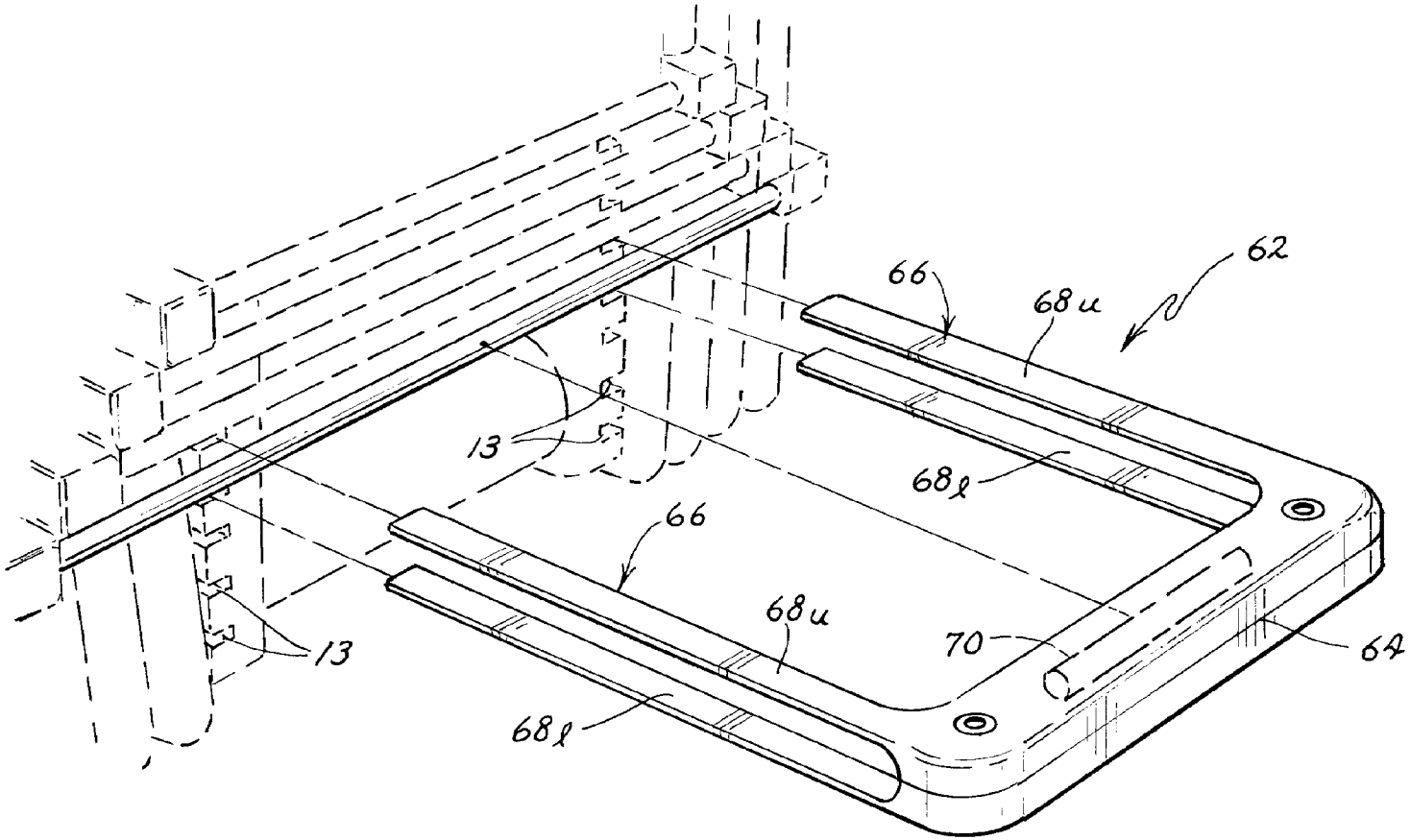
FIG. 12 is a perspective view of an alternative embodiment of a shock absorbing selector for the dumbbell of FIG. 6 or other dumbbells.

To avoid this disadvantage and as shown in FIG. 12, each flexible prong 66 on connecting pin 62 could be in the form of a tuning fork with upper and lower forks 68*u* and 68*l* that vertically overlie one another. Now, there are two flexible forks 68 on each prong 66 for coupling weights 4' to handle 8' rather than one. Each fork 68 of prong 66, and each slot 13 in handle 8', can be made narrower than in FIG. 6, i.e. on the order of ⅜ of an inch. This is the same size as the diameter of the circular metal prongs 66 of pins 62 on prior art PowerBlock dumbbells. Thus, selector 10' of FIG. 12, with the tuning fork shaped prongs 66, does not lead to an increase in the length of handle 8' or the length of dumbbell 2', but still provides adequate strength for lifting all the weights 4' and coupling them to handle 8'. This is an advantage.

In addition, base 64 of connecting pin 62 has one or more magnets 70 therein for being magnetically attracted to and magnetically coupling against side rail 30' or 32' of the outermost weight 4' that is to be coupled to handle 8', i.e. to side rail 30' or 32' of weight 4' beneath which pin 62 was intended to be inserted by the user. With a selector 10' as shaped in FIG. 6, if selector 10' is unintentionally inverted when prongs 66 are slid beneath side rail 30' or 32' of the desired weight, magnet(s) 70 in such a selector would unintentionally be magnetically coupled to side rail 30' or 32' beneath the side rail 30' or 32' of the weight 4' the user was trying to select. This causes some confusion and difficulty with operation of selector 10' since magnet(s) 70 are attracted to the intended side rail 30' or 32' only when selector 10' is inserted in its usual position and is not unintentionally inverted.

However, with selector 10' shown in FIG. 12, the upper and lower forks 68*u* and 68*l* of prongs 66 merely straddle side rail 30' or 32' of the weight the user is trying to couple to, with one fork 68 passing beneath side rail 30' or 32' and the other fork 68 passing above the same side rail 30' or 32'. Magnet(s) 70 is/are symmetrically located on base 64 between the upper and lower forks 68*u* and 68*l* and thus will be magnetically attracted to side rail 30' or 32' of the weight 4' the user is trying to couple to regardless of how selector 10' is inserted, i.e. whether selector 10' is inserted upright or inverted. Thus, the confusion that might exist with respect to the FIG. 6 style selector is obviated when using the FIG. 12 style selector. Magnet(s) 70 will always be attracted to side rail 30' or 32' of the right weight 4' as long as the user causes the two forks 68 of prong 66 to straddle that side rail as connecting pin 62 is being slid into slots 13 on handle 8'. If the FIG. 12 type selector 10' is used, ends 9*l* and 9*r* of handle 8' of dumbbell 2' have to be modified to add a further slot 13 above side rail 30' or 32' of the innermost weight, i.e. the uppermost side rail 30' shown in FIG. 6.

Figure 13:
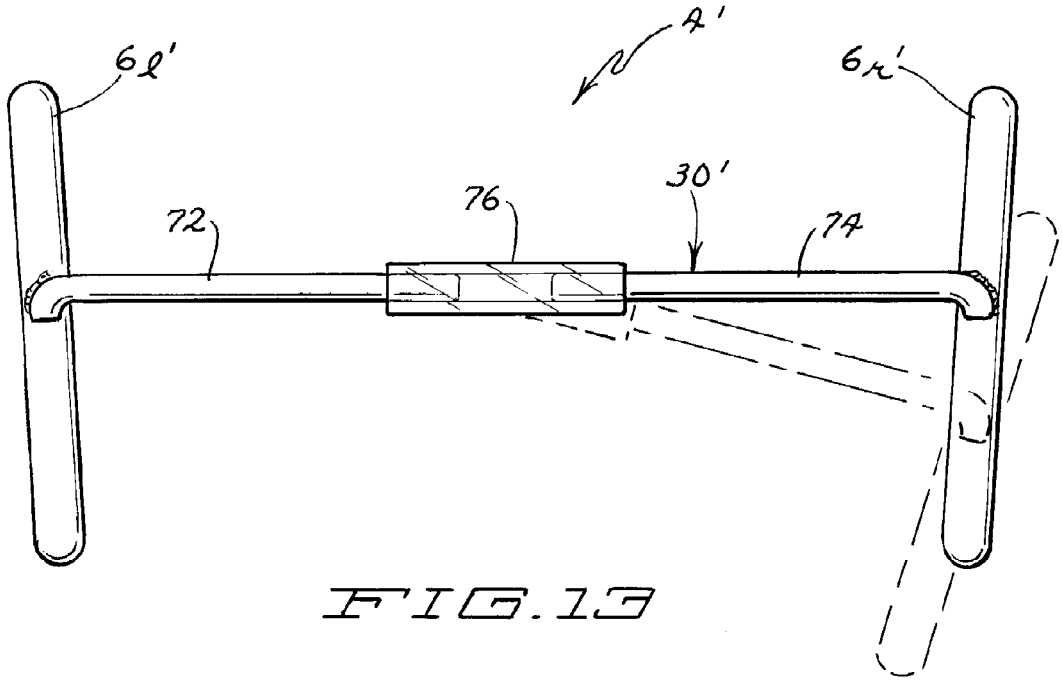
FIG. 13 is a front elevational view of one of the weights used in a dumbbell according to a further embodiment of this invention, wherein the side rails of the weight include both rigid and shock absorbing sections.

Referring now to FIG. 13, one of the weights 4' of another embodiment of a selectorized dumbbell 2' having a shock absorbing system is shown. In this weight, side rails 30', 32' connecting the left and right weight plates 6*l'* and 6*r'* do not extend completely across the distance between the left and right weight plates, but are split into left and right partial side rail sections 72, 74. Side rail sections 72, 74 are coupled together by a relatively stiff, but flexible, centrally disposed elastomeric sleeve 76.

Normally, sleeve 76 is stiff enough to hold the weight plates 6*l'* and 6*r'* aligned with one another as shown in solid in FIG. 13. However, sleeves 76 can flex or bend in response to an impact shock as shown in phantom in FIG. 13. When the shock passes and dumbbell 2' is lifted off the floor to remove frictional forces from acting on weight plates 6*l'* and 6*r'*, sleeves 76 can restore themselves and weight plates 6*l'* and 6*r'* to their original positions. In the dumbbell 2' shown in FIG. 13, weight plates 6*l'* and 6*r'* are simply metallic weight plates welded to the outer ends of the left and right side rail sections 72, 74 shown in FIG. 13.

Figure 14:
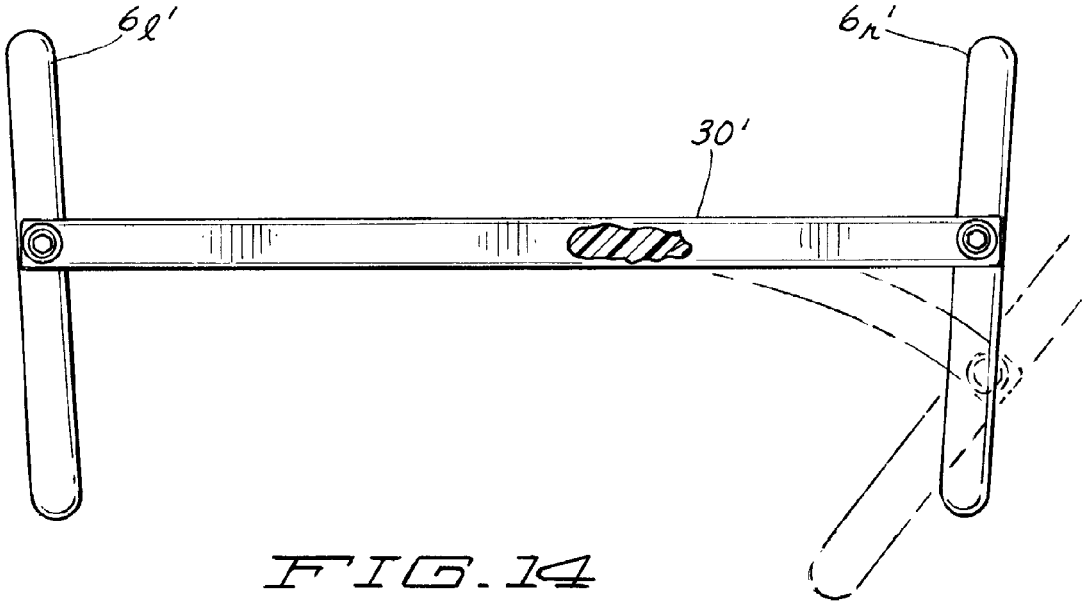
FIG. 14 is a front elevational of one of the weights used in a dumbbell according to yet an additional embodiment of this invention, wherein the side rails of the weight are made from a shock absorbing material.

FIG. 14 shows yet another alternative in which the entire side rail 30', 32' could be made of a flexible material, such as UHMW-PE. In this case the ends of side rails 30', 32' are merely bolted or pinned to the edges of metallic weight plates 6*l'* and 6*r'*. Side rails 30', 32' themselves bend or flex in response to an impact shock as shown in phantom in FIG. 14. When the shock passes and any frictional force tending to hold the weight plates in their deformed orientation is removed, side rails 30', 32' will restore themselves to their original positions to cause the weight plates 6*l'* and 6*r'* to restore to their usual orientation shown in solid in FIG. 14.

While all of the embodiments described above have some form of a shock absorbing system somewhere in the weights 4, 4', selector 10, 10' or handle 8, 8', or in some combination thereof, some aspects of the disclosure are useful in selectorized dumbbells 2' of the type shown herein absent and apart from the shock absorbing system. For example, elastomer encased weight plates 6*l'* and 6*r'* of the type shown herein and how they are connected to side rails 30', 32' provide desirable effects in terms of lessening noise and preventing scratches even if the weight plates **6*l*' and 6*r*' themselves have a very hard elastomer encasement 44 and even if a conventional selector 10 with metallic prongs 66 were used. Similarly, the shape of selector 10' shown in FIG. 12 would be useful with conventional PowerBlock dumbbells and even if prongs 66 were metallic and not flexible since it would be more foolproof in operation and magnet(s) 70 would always be attracted to side rail 30' or 32' of the selected weight despite possible inversion of selector 10'. Such a tuning fork shape for a connecting prong 66 would be useful even in a connecting pin 62 with a single such prong 66, i.e. weights 4' could be coupled to handle 8' using a single prong 66 that is inserted into a single array of slots 13**.

Various other modifications of this invention will be apparent to those skilled in the art. Thus, the scope of this invention is to be limited only by the appended claims.

We claim:

1. An adjustable selectorized dumbbell, which comprises:

(a) a plurality of nested weights having a plurality of members that vertically overlie one another in a vertical array, the members being separated by gaps therebetween;

(b) a handle which the user can grip to hold and manipulate the dumbbell, wherein the handle has a plurality of vertically spaced openings located adjacent the vertical array of members on the weights with the openings being vertically located on the handle such that each member of each weight is vertically straddled by a pair of openings adjacent the gaps above and below each member; and (c) a connecting pin having at least one fork-shaped connecting prong with a pair of upper and lower forks, wherein the connecting pin has the upper and lower forks thereof inserted into a pair of vertical openings with the upper and lower forks straddling the member of a particular weight to thereby couple to the handle the weight whose member is straddled along with all other weights whose members lie above the member straddled by the upper and lower forks.

2. The selectorized dumbbell of claim 1, wherein the openings comprise elongated slots in the handle, and wherein each upper and lower fork of each prong is substantially flat and leaf-shaped to slide into one of the slots in the handle.

3. The selectorized dumbbell of claim 1, wherein the openings face outwardly and are accessible from at least one side of the handle.

4. The selectorized dumbbell of claim 3, wherein the handle is elongated along an axis and the openings extend perpendicularly to the axis of the handle.

5. The selectorized dumbbell of claim 1, wherein the connecting pin is substantially U-shaped and includes a pair of the fork-shaped connecting prongs.

* * * * *